US005325757A

United States Patent [19]

Ghenea

[11] Patent Number: 5,325,757

[45] Date of Patent: Jul. 5, 1994

[54] FRET RETRACTABLE NECK FOR STRINGED MUSICAL INSTRUMENTS

[76] Inventor: Serban Ghenea, 15473 Hazelnut Crescent, Pierrefonds, Quebec H9H-4A8, Canada

[21] Appl. No.: 943,527

[22] Filed: Sep. 11, 1992

[51] Int. Cl.[5] ..... G10D 3/06

[52] U.S. Cl. ..... 84/314 R

[58] Field of Search ..... 84/293, 314 R, 316

[56] References Cited

U.S. PATENT DOCUMENTS

| | | | |
|---|---|---|---|
| D. 297,332 | 8/1988 | Marx | D17/20 |
| 1,727,230 | 9/1929 | Cox | 84/314 R |
| 3,943,816 | 3/1976 | Goursau | 84/293 |
| 4,189,974 | 2/1980 | Martin et al. | 84/293 |
| 4,297,936 | 11/1981 | Mouton | 84/314 R |
| 4,334,456 | 6/1982 | Martin et al. | 84/314 R |
| 4,722,260 | 2/1988 | Pigozzi | 84/314 R |
| 4,803,906 | 2/1989 | Fender | 84/293 |

*Primary Examiner*—Michael L. Gellner
*Assistant Examiner*—P. Stanzione
*Attorney, Agent, or Firm*—Griffin Butler Whisenhunt & Kurtossy

[57] ABSTRACT

A stringed musical instrument (12) that can be played either in a fretted or a fretless mode includes an interconnected fret assembly (38) including frets (24) and a longitudinal fret interconnecting member (40) that is attached to, and movable with, the frets. A movable linear cam structure (46) has two cams at each fret, one positioned on each side of the fret interconnecting member, and includes rack teeth (52) which mesh with a pinion (62) driven by a lever (66) for causing linear movement of the linear cam structure. The interconnecting member is an elongated slat (40) which is positioned in a slot (50) between the cams. The linear-movable cam includes an elongated guide protrusion (56) and an interior cavity (30) of the fingerboard, in which the cam rides, defines an elongated guide slot (58) for receiving the guide protrusion and thereby limiting lateral movement of the linear cam. The linear cam structure and the interior cavity have tapered lateral sides.

20 Claims, 5 Drawing Sheets

FRET RETRACTABLE NECK FOR STRINGED MUSICAL INSTRUMENTS

BACKGROUND OF THE INVENTION

This invention relates generally to stringed musical instruments and more specifically to such instruments having fingerboards, normally on necks thereof.

Stringed musical instruments, such as four-string bass guitars or conventional six-string guitars, are often specialized, most being fretted but some being fretless. Each type instrument has unique identifiable sounds which makes it preferable for use in certain music styles. For examples, a fretless electric bass guitar is very popular for use with jazz music because of its sound, which is similar to that of an upright acoustic bass fiddle, whereas fretted bass guitars are more popular in funk rock and country music.

However, due to changes in musical trends and the merging of various musical styles, new music has been created which combines different aspects of different types of music. Thus, it is no longer uncommon to hear instruments which were previously restricted to certain types of music played together in the same songs with instruments which were restricted to other types of music. Further, many musicians simply enjoy playing in different musical styles. For this reason, many players purchase both fretted and fretless instruments so that they can create the various different types of sounds. Although this allows musicians to play both fretted and non-fretted types of music, it is relatively expensive. Further, it is inconvenient for musicians to have to transport and maintain two different instruments rather than only one. For this reason, it is an object of this invention to provide a stringed musical instrument that can be played either as a fretted instrument or as a fretless instrument.

A related problem is that some music demands that the different sounds of fretted and fretless instruments be played in quick consecutive order, alternating from one type to the other within a song. Even when a musician has two different guitars, for example, it is difficult and extremely inconvenient to continually change instruments, and in some songs it is virtually impossible. For this reason, it is often necessary to have two musicians each playing a different instrument in order to achieve desired different sounds in sequence. Again, it is expensive to provide two musicians for performing music which otherwise could be performed by one performer and also it is difficult for a single performer to provide an adequate performance when he must continually switch instruments. Thus, it is an object of this invention to provide a single stringed musical instrument that can be easily and quickly switched between fretted and unfretted modes of operation.

Several stringed instruments have been suggested which allow transformation between fretted and unfretted operation. For example, U.S. Pat. No. 4,297,936 to Mouton describes an electric bass guitar having laterally retractable frets. In this case, the frets are commonly attached at lateral ends thereof to a flexible thumb bar which runs parallel to a guitar neck. The thumb bar is so flexible that when a player applies lateral pressure, only adjacent frets are activated, with others remaining unperturbed. One difficulty with the guitar of Mouton is that the laterally extending frets get in the way and the guitar does not look or feel like a conventional instrument. Further, there is a fret hold-down tension wire therein which extends the length of the guitar neck and which allows simultaneous movement of all the frets. This wire could create an extraneous vibration, which is undesirable. Further, the frets of this instrument are somewhat cumbersome not being positively secured in their positions nor including a simultaneous positive adjustment of all frets since a wire could tend to bow if a fret meets movement resistance.

Thus, it is an object of this invention to provide a stringed musical instrument that can be played either as a fretted or a fretless instrument, which has an appearance quite similar to that of conventional stringed instruments, which has a positive, accurate and sturdy simultaneous adjustment of all frets, and which does not include an unduly flexible structure which could cause undesirable vibrations.

U.S. Pat. No. 4,722,260 to Pigozzi describes a stringed musical instrument having retracting frets with each fret being driven by two rotating cams, one located on each side of center of the fret. Each fret is separately biased downwardly by a coiled spring acting on a lateral shaft extending into a neck of the stringed instrument. The cams are simultaneously rotated by two longitudinal shafts which are driven by a central pinion attached to a knob. A major problem with the musical instrument of this patent is that the neck thereof is unduly weakened by the structures of the fret actuating mechanisms. Further, because of the positions of these mechanisms, it is not possible to have a normal truss rod running along the neck on a side thereof opposite to the strings to counteract tension of the strings. Yet another difficulty with the stringed musical instrument of Pigozzi is that it appears to be somewhat complicated in structure having many different pieces which require an undue amount of time and undue expenditure of labor to manufacture. Also, the appearance of the guitar itself is not conventional. For this reason, it is an object of this invention to provide a stringed musical instrument whose neck is quite similar in structure and shape to a neck of a normal stringed instrument but yet is quite strong, allowing the use of a normal truss rod to counteract string tension. It is a further object of this invention to provide a stringed musical instrument which has relatively few parts and is therefore relatively easy, and not time-intensive, to construct.

Yet another object of this invention is to provide a stringed musical instrument which can be played both as a fretted and as a fretless instrument, operating effectively in both modes in substantially the same manner as respective conventional fretted and fretless instruments.

SUMMARY

According to principles of this invention, a stringed musical instrument that can be played either as a fretted or as a fretless instrument includes a longitudinally-movable cam structure movably mounted within an interior cavity of a fingerboard having individual cams for impinging on respective ones of frets for selectively moving the frets through slots in the fingerboard and an interconnected fret assembly comprising a plurality of frets having a longitudinal fret interconnecting member that is rigidly attached to and movable with the frets. Biasing springs act on the fret interconnecting member for biasing the frets inwardly into the fingerboard. The cam structure comprises an elongated rack having two cams at each fret, and defining rack teeth. A pinion, driven by a lever, mounted to the fingerboard engages the rack teeth moving the cam structure longitudinally for effecting the degree to which the cams impinge on the frets.

The interconnecting member comprises an elongated slat and the linearly-movable cam structure defines a fret guide slot between the cams for receiving the elongated slat. The linearly-movable cam structure includes an elongated guide protrusion and the fingerboard defines an elongated guide slot for receiving the guide protrusion to limit lateral movement of the linear cam structure. The linearly-movable cam structure has tapered lateral sides and the interior cavity of the fingerboard is also correspondingly tapered along the length thereof.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 2(*b*) is a cross-sectional view also taken on line II—II in FIGS. 1 and 3(*a*) illustrating the frets in protracted, or playing, positions.

FIG. 3(*b*) is cross-sectional view taken on line III—III in FIG. 1 illustrating the frets in their protracted, or playing, positions.

DESCRIPTION OF A PREFERRED EMBODIMENT

Figure 1:
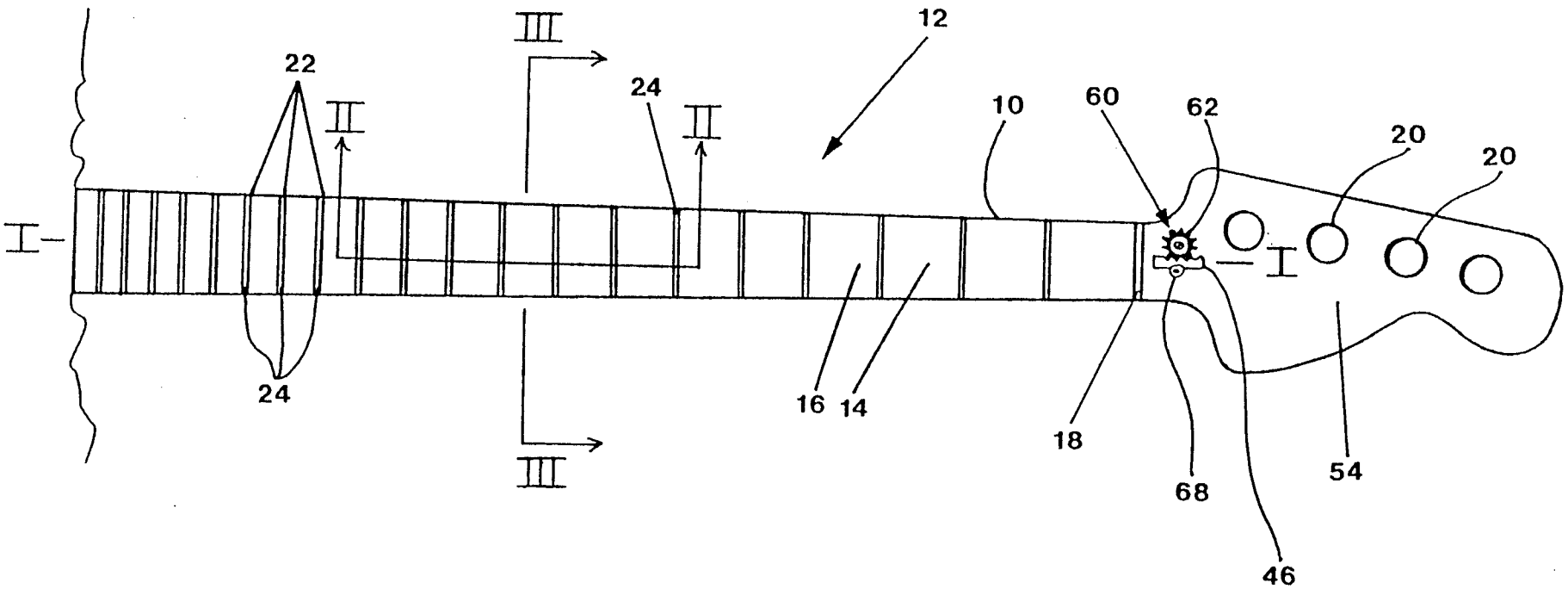
FIG. 1 is top view of a neck of a stringed musical instrument of this invention including a fingerboard.

A neck 10 of a stringed musical instrument 12 that can be played either as a fretted instrument or as a fretless instrument includes a fingerboard 14 defining a top surface 16. The fingerboard 14 has, near a tuning pin plate, or "headstock", 54 with tuning pins 20, a string supporting nut 18 on the top surface. The stringed musical instrument 12 depicted, for example, is a four-string bass guitar which operates according to the principles of this invention. The fingerboard 14 defines laterally elongated fret slots 22 in which laterally elongated movable frets 24 are positioned.

Figure 3A:
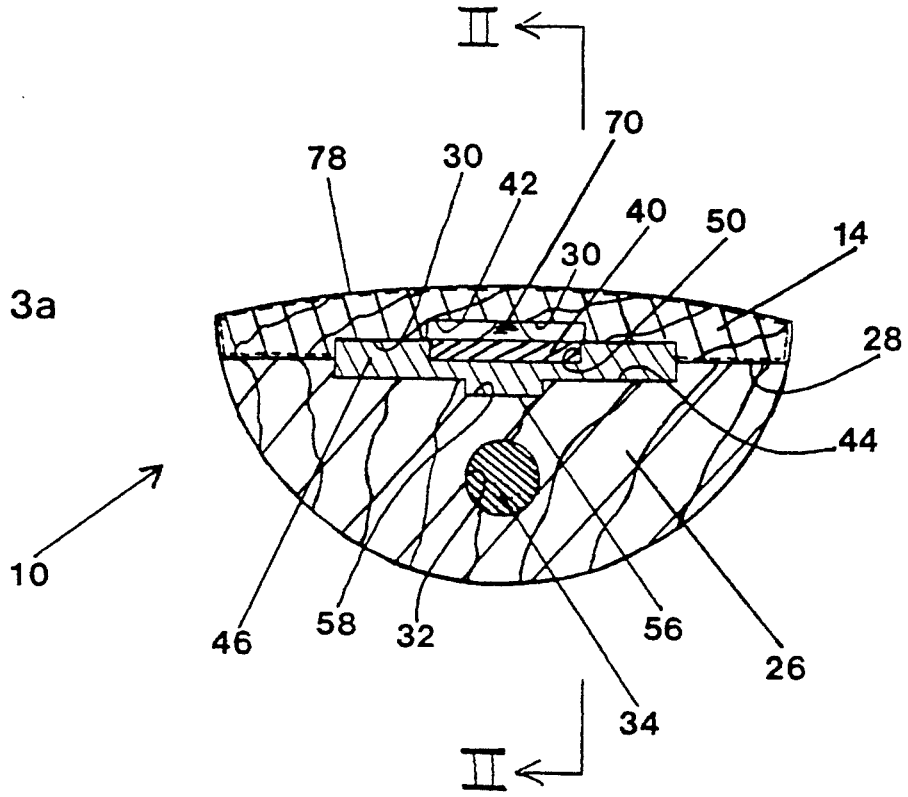
FIG. 3(*a*) is a cross-sectional view taken on line III—III in FIG. 1 illustrating the frets in retracted positions.
Figure 3B:
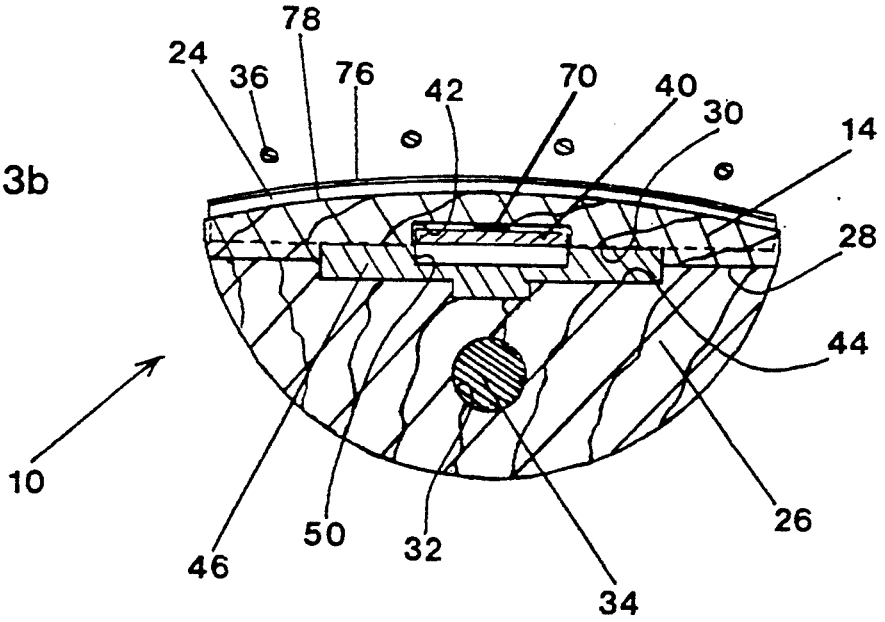

As can be seen in FIGS. 3(*a*) and 3(*b*), the neck 10 is comprised of a base board 26 which is laminated to the fingerboard 14 at an interface 28. The neck 10 also defines an interior cavity 30 at the interface 28. The base board 26 defines a circular cavity 32 along the length thereof for receiving a truss rod 34 which stiffens the neck 10 and counteracts tension of strings 36.

The frets 24 are part of an interconnected fret assembly 38. That is, the frets 24 are interconnected by a longitudinal fret interconnecting member 40 which is basically an elongated slat which is substantially rigidly connected to each of the frets 24. The longitudinal fret interconnecting member 40 rides in an upper portion 42 of the interior cavity 30 of the neck 10.

Figure 4:
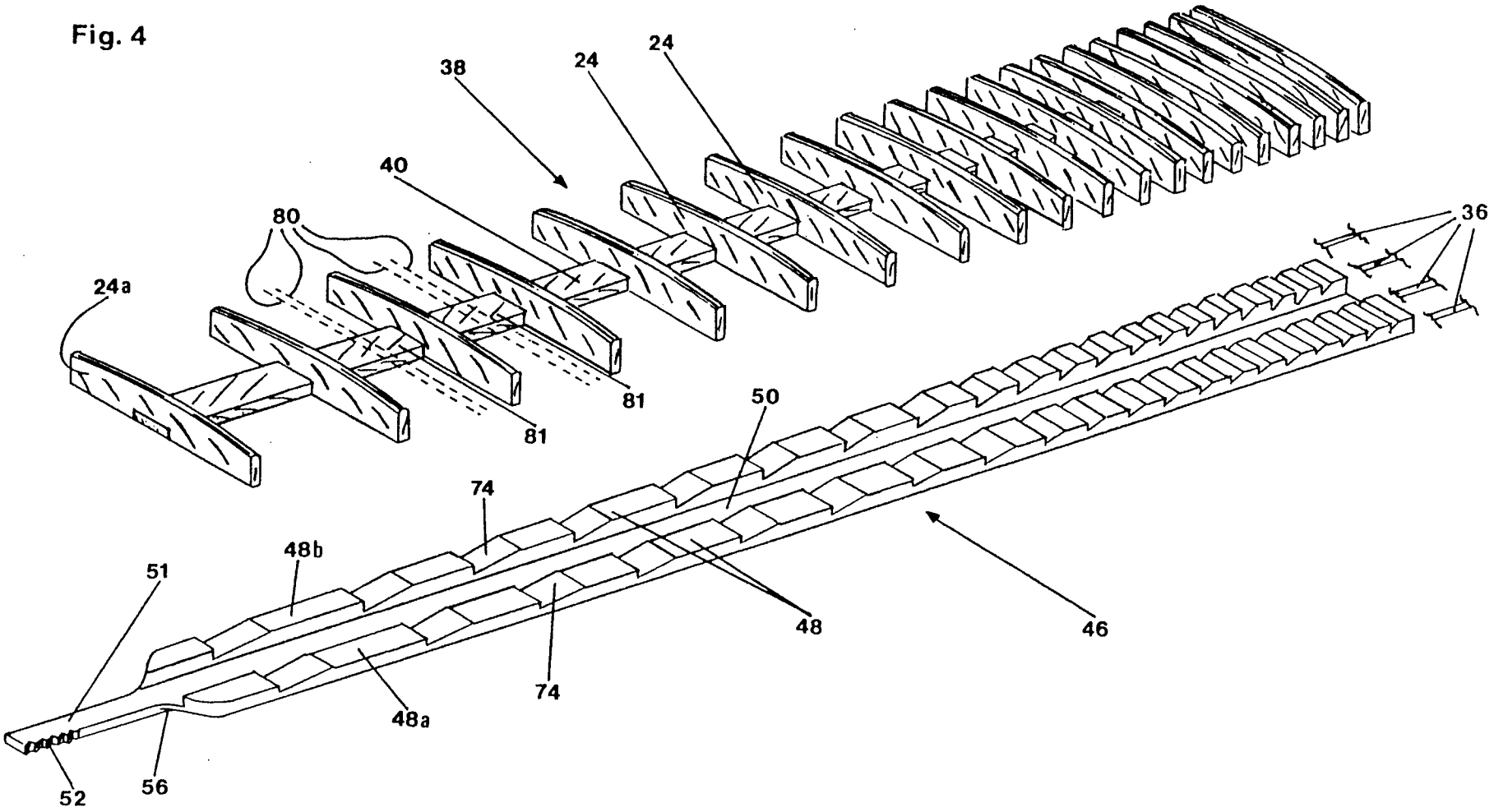
FIG. 4 is an isometric view of an interconnected fret assembly and a linear cam structure of this invention.
Figure 5:
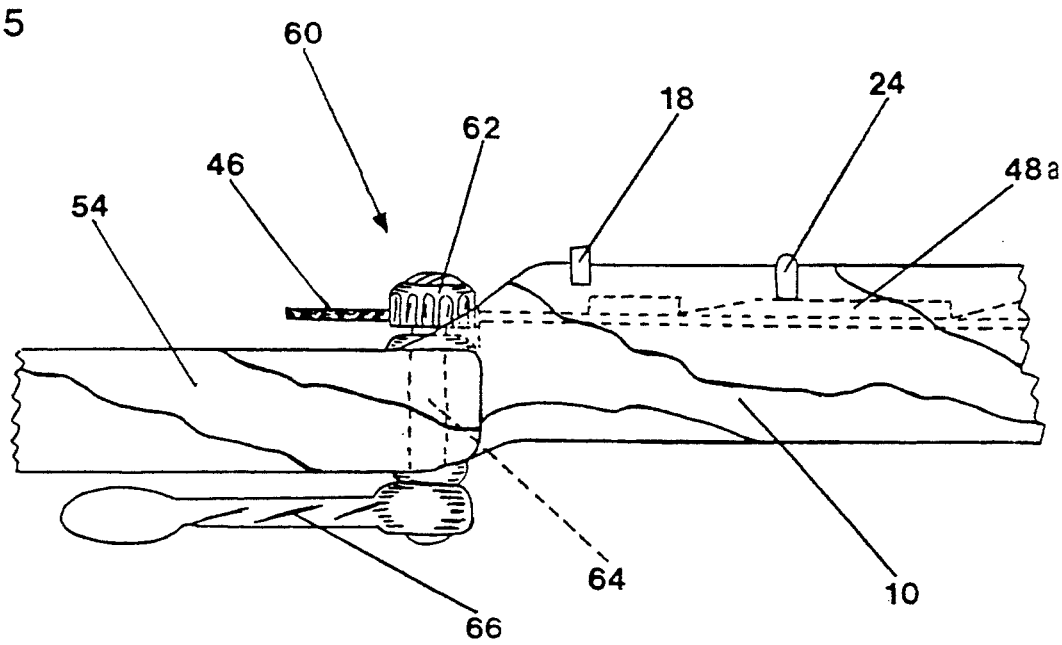
FIG. 5 is a side, enlarged, fragmented view of a portion of the neck of the musical instrument of FIG. 1 including a fret control mechanism of this invention mounted on the neck.

Slidably positioned in a lower portion 44 of the interior cavity 30 is a linearly-movable cam structure 46 having individual linear cams 48 thereon for respectively impinging on the frets 24. In this regard, there is a spaced cam pair, for example cam pair 48*a*, 48*b*, for each fret, for example fret 24*a*. The cam pairs are spaced from one another a distance which is at least as great as the width of the longitudinal fret interconnecting member so that the cams of a pair impinge on opposite end portions of a respective fret, thereby maintaining the fret in a stable attitude while allowing it and the connecting member 40 to move downwardly (as seen in FIG. 3(*a*)), or inwardly, in a slot 50 of the cam structure 46 formed between linear cams 48 of the cam pairs. The cam structure 46 includes a rack 51, having teeth 52 at an edge thereof, which extends below and beyond the string supporting nut 18 above the tuning pin plate 54. The cam structure 46 also includes an elongated guide protrusion 56 which rides in an elongated guide slot 58 of the fingerboard 14 which is part of the lower portion 44 of the interior cavity 30. Interlocking of the elongating guide protrusion 56 with the elongated guide slot 58 ensures that the cam structure 46 moves linearly within the interior cavity 30 along the neck 10. In this regard, the interior cavity 30 has a tapered shape which is smallest close to the tuning pin plate 54 and is largest at the opposite end of the neck 10, corresponding to the tapered shape of the cam structure 46, as can be seen in FIG. 4. Thus, it is desirable to have a guide within the interior cavity 30, such as the elongated guide slot 58 which cooperates with the elongated guide protrusion 56, to ensure only linear movement of the cam structure 46 as it is moved away from the tuning pin plate 54.

A fret control mechanism 60 comprises a pinion 62 affixed to a shaft- 64 extending through the tuning pin plate 54. The shaft 64 is affixed to a lever 66 below the tuning pin plate 54. The fret control mechanism 60 further comprises a support guide 68 which slidingly engages the rack 51 opposite the pinion 62 whose teeth engage the teeth 52 of the rack 51.

Mounted in the upper portion 42 of the interior cavity 30 between the longitudinal fret interconnecting member, or slat, 40 and an interior surface of the fingerboard 14 are biasing devices in the form of a plurality of leaf springs 70. In this respect, there is a leaf spring 70 between each fret 24 urging the slat, or longitudinal fret interconnecting member 40, along with all of the frets 24 downwardly within the upper portion 42 of the interior cavity 30 to a position shown in FIG. 3(*a*). On the other hand, the linear cams 48 of the cam structure 46, when the cam structure 46 is pulled forwardly (toward the tuning pin plate 54), urge the frets 24 upwardly, thereby deforming the springs 70, to the position shown in FIG. 3(*b*).

Figure 2A:
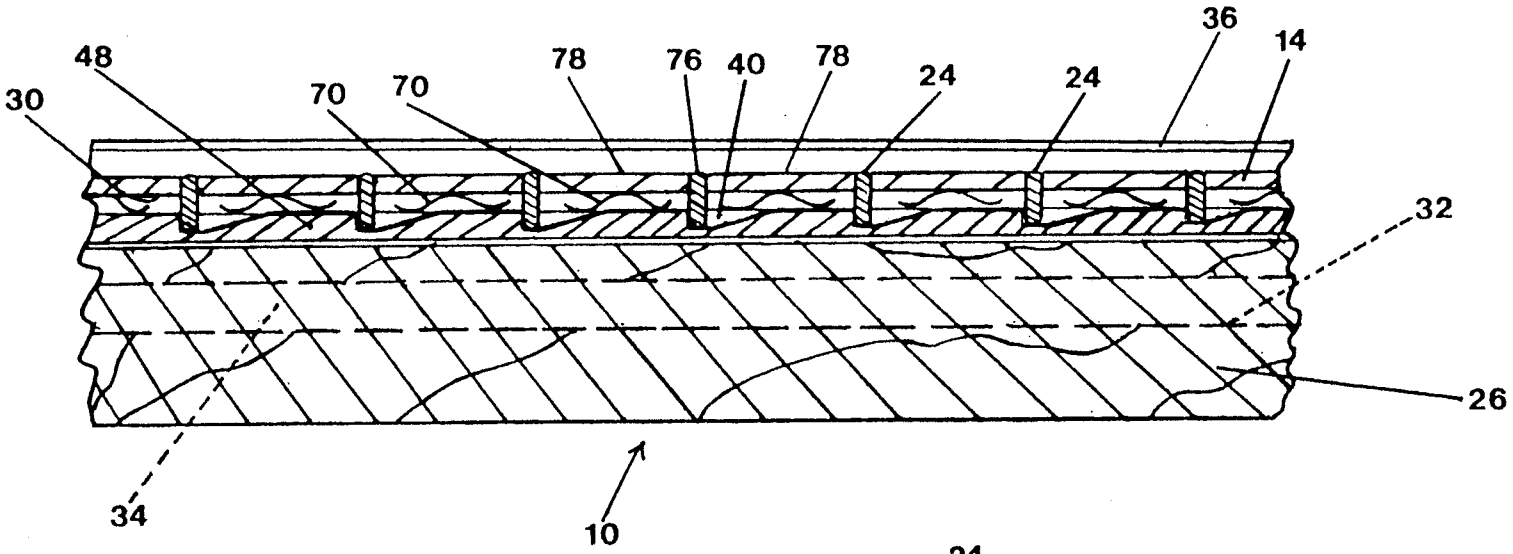
FIG. 2(*a*) is a cross-sectional view taken on line II—II in FIGS. 1 and 3(*a*), illustrating frets in retracted positions.
Figure 2B:
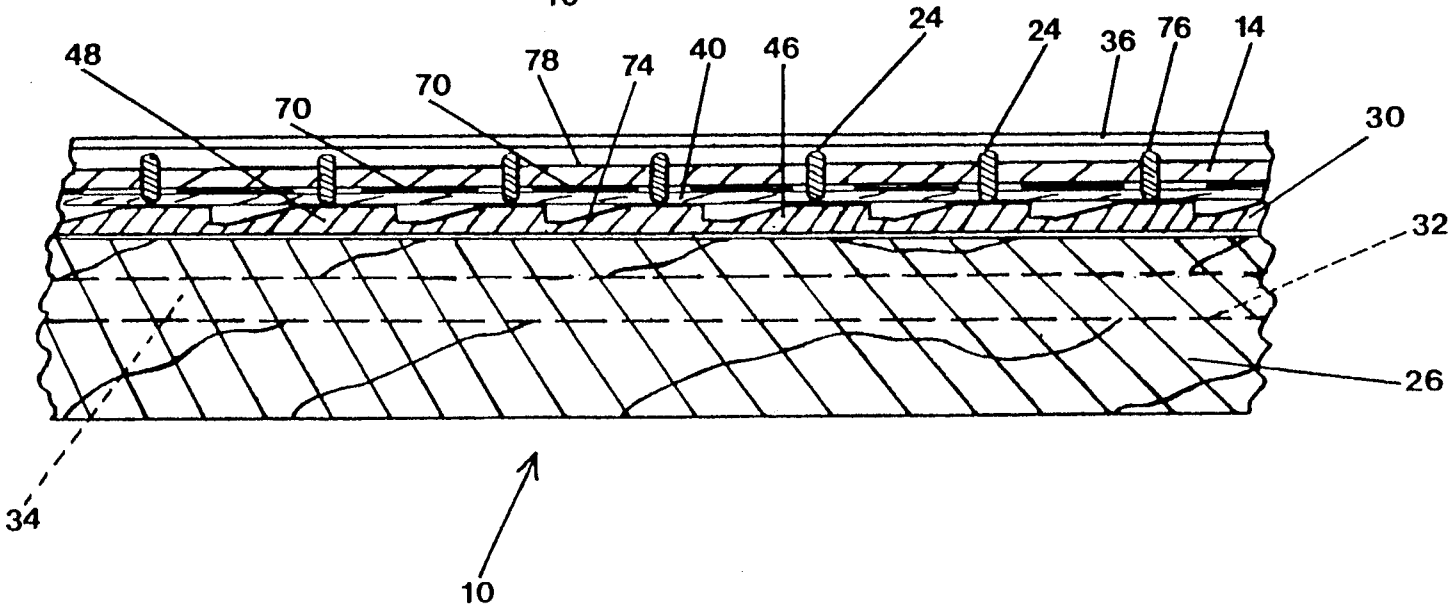
Figure 6:
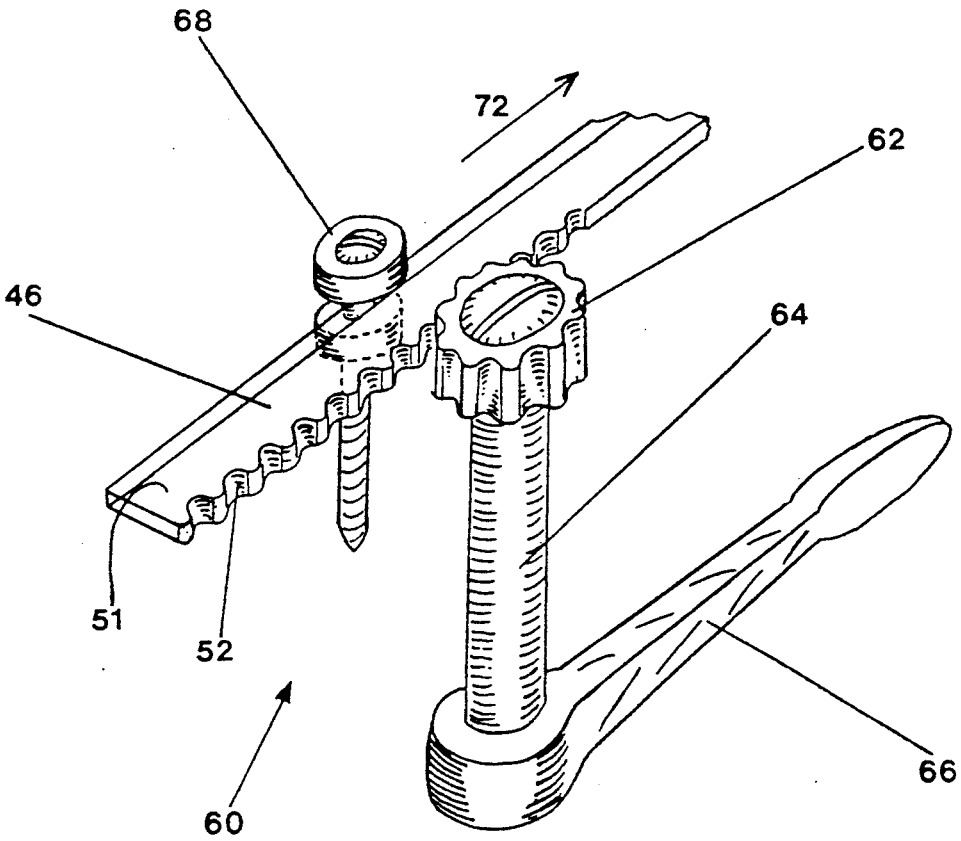
FIG. 6 is an enlarged perspective view of portions of the fret control mechanism of FIG. 5.

Turning now to operation of the stringed musical instrument 12 of this invention, when the musical instrument is in a fretted instrument mode, the fret lever 66 is rotated in a clockwise direction, as seen in FIG. 6, so as to drive the rack 51 and its cam structure 46 outwardly in the direction of an arrow 72. In this position, the linear cams are moved so that the frets 24 can slide down slopes 74 of the linear cams 48 and the leaf spring 70 can thereby urge the frets 24 downwardly along these slopes 74. Eventually, the frets 24 arrive at a position in which their top surfaces 76 are flush with or slightly below, an outer surface 78 of the fingerboard 14, as is shown in FIG. 2(*a*) and 3(*a*). Thus, in this configuration, when the guitar strings 36 are urged downwardly against the outer surface 78 of the fingerboard 14, they do not impinge on any of the top surfaces 76 of the frets 24 and the instrument can, thereby, be played as a fretless instrument. In this mode of operation, the slat 40 is nested between the linear cams 48 of linear cam pairs in the slot 50.

When it is desired, however, to play the stringed musical instrument (12) as a fretted musical instrument, the fret lever 66 is rotated counterclockwise to the FIG. 6 position so that the pinion 62 drives the rack 51 and cam structure 46 in a direction opposite to the arrow 72 so that the cam structure 46 is in a position depicted in FIGS. 2(*b*) and 3(*b*). In this configuration, the frets 24 have ridden up slopes 74 of the linear cams 48 and they carry the slat, or longitudinal fret interconnecting member, 40 with them to compress the leaf springs 70 against the interior surface of the fingerboard 14, as is depicted in FIGS. 2 (*b*) and 3 (*b*) . In this configuration, as can be seen in FIGS. 2 (*b*) and 3 (*b*) , top surfaces 76 of the frets 24 are well above the outer surface 78 of the fingerboard 14 so that when the guitar strings 36 are pressed against the outer surface 78 of the fingerboard 14 they impinge on the top surfaces 76 of the frets 24. Thus, the instrument is now played as a fretted instrument.

It will be appreciated by those of ordinary skill in the art that the stringed musical instrument of this invention can be relatively easily assembled, since its operational parts mainly comprise the interconnected fret assembly 38, the cam structure 46, and the fret control mechanism 60, all of which are relatively uncomplicated parts. In this regard, since one must not deal with many individual frets during assembly, the assembly process is somewhat simplified. Further, it will be appreciated that linear movement of the cam structure 46 is relatively uncomplicated as opposed to movements of many separated cams and parts.

A further benefit of this invention is the stability provided by the linear cams which contact opposite ends of the individual frets so that the frets are extremely stable when the stringed musical instrument is played in a fretted configuration.

A related benefit of the cam structure 46 and the interconnected fret assembly 38 is that they take up very little space in the neck 10 of the musical instrument so that the neck has basically the same appearance as a neck of a conventional instrument. Similarly, because these structures use so little space in the neck, the neck can still have a normal truss rod 34 to counteract string tension mounted therein.

Also a benefit of this invention is the uncomplicated manner in which the fret control mechanism is assembled and operated. In this respect, the fret lever 66 can be easily manipulated by a performer during a performance for quickly converting the stringed musical instrument between fretted and unfretted modes.

Yet another benefit of this invention is that the linear cam structure 46 provides a positive and sturdy fret adjustment of all frets simultaneously. In this regard, there is a rigid coupling, or linkage between all of the cams so that all of the frets are simultaneously, positively moved.

It is a further benefit of this invention that the frets are combined into an interconnected fret structure which also contributes to stable and positive movements of frets between fretted and fretless modes.

A further benefit is that, in one embodiment of this invention, the cam structure can be of molded plastic, which is inexpensive.

While the invention has been particularly shown and described with reference to a preferred embodiment, it will be understood by those skilled in the art that various changes in form and detail may be made therein without departing from the spirit and scope of the invention. For example, it is not necessary that leaf springs be used for biasing but rather other types of biasing apparatus can be utilized in the invention. Also, the lever 66 could be a knob or other mechanism. Also, any such mechanism could be power driven (electrical motor, for example).

Still further, it would be possible to cut through (or disconnect) the longitudinal fret interconnecting member between each fret at dashed lines 80, for example. Thus, each of the frets 24, would then be separate from adjacent frets and each would have laterally-extending internal member 81 on which biasing springs could impinge to bias the frets inwardly in the same manner as the leaf spring 70 in the above described embodiment. In the depicted embodiment, the laterally-extending internal members extend in a longitudinal direction of the elongated neck 10.

The embodiments of this invention in which an exclusive property or privilege are claimed are defined as follows.

I claim:

1. A stringed musical instrument that can be played either as a fretted or as a fretless instrument of a type comprising a fret fingerboard having a fingerboard surface defining fret slots with movable frets mounted therein, said stringed musical instrument comprising:

a cam structure movably mounted within an interior cavity of the fingerboard for impinging on respective ones of the frets for selectively moving the frets outwardly through the slots in the fingerboard to extend exteriorly of the fingerboard surface and for allowing the frets to be returned into the interior of the fingerboard approximately at or below the fingerboard surface;

an interconnected fret assembly comprising said frets and a longitudinal fret interconnecting member that is attached to and movable with the frets.

2. A stringed musical instrument as in claim 1 wherein is further included a biasing means acting on the fret interconnecting member tending to move said frets between said fretted and fretless modes.

3. A stringed musical instrument as in claim 2 wherein said cam structure is linearly movable.

4. A stringed musical instrument as in claim 3 wherein said cam structure comprises an elongated rigid member having two cams at each fret, one cam positioned on each side of the fret interconnecting member.

5. A stringed musical instrument as in claim 4 wherein said cam structure includes rack teeth and said musical instrument comprises a pinion driven by a lever having teeth which engage with the rack teeth for moving the cam structure longitudinally for thereby affecting movement of said frets.

6. A stringed musical instrument as in claim 4 wherein said interconnecting member comprises an elongated slat and said linearly-movable cam defines a fret guide slot between said cams for receiving said elongated slat.

7. A stringed musical instrument as in claim 6 wherein said linearly-movable cam includes an elongated-guide-protrusion means and said fingerboard defines an elongated guide slot for receiving said guide protrusion for thereby limiting lateral movement of said linear cam while allowing linear movement thereof.

8. A stringed musical instrument as in claim 7 wherein said linearly-movable cam has tapered lateral side edges and said cavity in said fingerboard has tapered dimensions corresponding to the taper of the side edges of said linearly-movable cam.

9. A stringed musical instrument as in claim 3 wherein said linearly-movable cam includes an elongated-guide-protrusion means and said fingerboard defines an elongated guide slot for receiving said guide protrusion for thereby limiting lateral movement of said linear cam while allowing linear movement thereof.

10. A stringed musical instrument as in claim 9 wherein said linearly-movable cam has tapered lateral side edges and said cavity in said fingerboard has tapered dimensions corresponding to the taper of the side edges of said linearly-movable cam.

11. A stringed musical instrument as in claim 1 wherein said cam structure is linearly movable.

12. A stringed musical instrument as in claim 11 wherein said cam structure comprises an elongated rigid member having two cams at each fret, one cam positioned on each side of the fret interconnecting member.

13. A stringed musical instrument as in claim 12 wherein said cam structure includes rack teeth and said musical instrument comprises a pinion driven by a lever having teeth which engage with the rack teeth for moving the cam structure longitudinally for thereby affecting movement of said frets.

14. A stringed musical instrument that can be played either as a fretted instrument or as a fretless instrument of a type comprising a fingerboard having a fingerboard surface defining fret slots with movable frets therein, said stringed musical instrument comprising:

a linearly-movable cam structure movably mounted within an interior cavity of the fingerboard for impinging on each of the frets for selectively moving the frets between a fretted position in which they extend outwardly through the fret slots in the fingerboard exteriorly of the fingerboard surface, and a fretless position in which they are in the interior thereof approximately at or below the fingerboard surface.

15. A stringed musical instrument as in claim 14 wherein said cam structure is coupled to rack teeth and said musical instrument comprises a pinion driven by a lever having teeth which engage with the rack teeth for moving the cam structure longitudinally for thereby affecting movement of said frets.

16. A stringed musical instrument as in claim 15 wherein said linearly-movable cam includes an elongated-guide-protrusion means and said fingerboard defines an elongated guide slot for receiving said guide protrusion for thereby limiting lateral movement of said linear cam while allowing linear movement thereof.

17. A stringed musical instrument as in claim 16 wherein said linearly-movable cam has tapered lateral side edges and said cavity in said fingerboard has tapered dimensions corresponding to the taper of the side edges of said linearly-movable cam.

18. A stringed musical that can be played either as a fretted or as a fretless instrument of a type comprising a fret fingerboard having a fingerboard surface defining fret slots with movable frets mounted therein, said stringed musical instrument comprising:

a cam structure movably mounted within an interior cavity of the fingerboard for impinging on respective ones of the frets for selectively moving the frets outwardly through the slots in the fingerboard to extend exteriorly of the fingerboard surface and for allowing the frets to be returned into the interior of the fingerboard approximately at or below the fingerboard surface;

laterally-extending internal members attached to each of the frets positioned in the interior of the fingerboard and biasing means impinging on the laterally-extending internal members for biasing the frets inwardly; wherein the fingerboard is an elongated neck and the laterally-extending internal members extend away from the frets in the direction of elongation of the neck.

19. A stringed musical instrument as in claim 18 wherein the laterally-extending internal members of adjacent frets are not interconnected.

20. A stringed musical instrument as in claim 18 wherein the laterally-extending internal members of adjacent frets are interconnected.

* * * * *